US006624381B1

(12) United States Patent
Haffner

(10) Patent No.: US 6,624,381 B1
(45) Date of Patent: Sep. 23, 2003

(54) DEVICE FOR SUPPLYING STRIP FLEXIBLE MATERIAL TO A WORK STATION

(75) Inventor: Serge Luc Haffner, Servance (FR)

(73) Assignee: Manufacture de Linge de Maison, Le Thillot (FR)

( * ) Notice: Subject to any disclaimer, the term of this patent is extended or adjusted under 35 U.S.C. 154(b) by 0 days.

(21) Appl. No.: 09/856,509

(22) PCT Filed: Dec. 2, 1999

(86) PCT No.: PCT/FR99/02996

§ 371 (c)(1),
(2), (4) Date: Jun. 15, 2001

(87) PCT Pub. No.: WO00/35794

PCT Pub. Date: Jun. 22, 2000

(30) Foreign Application Priority Data

Dec. 15, 1998 (FR) ..... 98 15835

(51) Int. Cl.[7] ..... B23K 26/38; B65H 20/18

(52) U.S. Cl. ..... 219/121.67; 219/121.82; 226/95; 226/162

(58) Field of Search ..... 219/121.67, 121.82, 219/79; 242/594.5, 594.6; 26/51–53; 38/143; 226/95, 158, 162; 112/304, 305, 307

(56) References Cited

U.S. PATENT DOCUMENTS 3,614,369 A * 10/1971 Medley ..... 219/121.72
4,529,128 A * 7/1985 Sando et al. ..... 239/138

FOREIGN PATENT DOCUMENTS

| | | |
|---|---|---|
| DE | 36 10551 | 5/1987 |
| DE | 0 384 136 | 8/1990 |
| DE | 0 507 733 | 10/1992 |
| EP | 0 860 249 | 8/1988 |
| EP | 0 507 733 A1 * | 10/1992 |
| FR | 2 172 530 | 9/1973 |

* cited by examiner

*Primary Examiner*—Kuang Y. Lin
*Assistant Examiner*—Kevin McHenry
(74) *Attorney, Agent, or Firm*—Jacobson Holman PLLC

(57) ABSTRACT

A device for supplying a work station with a strip flexible material unwound from a reel including a transfer plate, driven in a translation motion with a longitudinal horizontal axis, by displacing between a first position for loading the material strip and a second so-called working position. The transfer plate including a first device for immobilising the strip on the plate when the latter is moving from the loading position to the working position. The transfer plate is capable of supporting on its surface the material strip, and the work station including a second blocking device for retaining the free end of the strip, such that the transfer plate return travel from the work position to the loading position generates, by the friction of the strip on the plate, forces tending to spread the part of the strip associated with the work station.

11 Claims, 3 Drawing Sheets

DEVICE FOR SUPPLYING STRIP FLEXIBLE MATERIAL TO A WORK STATION

FIELD OF THE INVENTION

The present invention relates to the field of devices for supplying strip flexible material unwound for example from a reel, in order to feed a work station.

BACKGROUND OF THE INVENTION

French Patent No. 2 172 530 discloses a device for automatically advancing film, comprising drive members adapted to drive said film.

In addition, document EP 0 860 249 presents a method and device intended for cutting a sheet of material positioned on a cut-out table.

Finally, document DE A 36 10 561 describes a device of known type allowing a strip of synthetic material to be clamped and advanced.

Patent EP 507 733 has proposed, in known manner, a system for supplying a cutout table with sheets, comprising a support plate adapted to move, driving the sheet of material which is then blocked in the cutout station by a vacuum effect created in the latter.

This known device presents the drawback of blocking the sheet over all the active surface of the work station. In this way, if folds are created during transport of the sheet, there is a risk of the strip not being cut to the desired length.

In addition, this known device only makes X possible to separate the sheet from its roll and not to effect other operations on this sheet, since it is applied over the whole of its surface on the support plate.

SUMMARY OF THE INVENTION

The present invention has for its object to overcome these drawbacks by proposing a device adapted to supply strip flexible material to a work station, and to dispose said strip on the work station so as to allow its treatment under optimum conditions, particularly of tension in order to eliminate pleats of the strip.

According to a second aspect, the present invention allows supply of multi-layer strip mattresses to a cut-out station.

Clothes for dean rooms require considerable precautions at manufacture, particularly for reasons of protection and hygiene. After each pattern has been individually cut-out, known processes effect assembly in several operations, including oversewing, i.e. a seam along the cut-out in order to fix the fibers of the edges, and a double fold to imprison them definitively, These known processes involve considerable additional costs when the clothes are manufactured and difficult working conditions for the operators, as these operations are partly manual.

Moreover, for reasons of productivity, individual cut-out of each pattern is particularly expensive.

The present invention overcomes these problems by effecting the supply, then the simultaneous cut-out, of a mattress of fabric comprising different layers of materials (for overgarments intended for clean rooms), by means of a laser beam.

According to the first aspect of the invention, the device for supplying a work station with strip flexible material unwound from a reel, comprising a transfer plate, animated by a translation motion with longitudinal horizontal axis, by displacing means, between a first position of loading the material strip and a second, so-called working position, said transfer plate including first means for immobilising the strip on said plate when the latter is moving from the loading position to the working position, is characterized in that the transfer plate is capable of supporting on its surface the material strip and in that the work station comprises second blocking means for retaining the free end of the strip, such that the transfer plate return travel from the work position to the loading position generates, by the friction of the strip on said plate, forces tending to smooth out the part of the strip associated with the work station.

Advantageously, the strip flexible material is composed of a plurality of independent, superposed layers or widths of material.

According to a preferred form of embodiment, the work station comprises a work table on which the strip flexible material can be placed upon the return of the transfer plate.

In order to cooperate with the work table, the transfer plate lies above and plumb with said work table.

According to another particular form of embodiment, the means for displacing the transfer plate comprise guide and driving means.

The first blocking means preferably comprise means for clamping said strip on the plate, for example by means of a jack fast with said transfer plate.

The second blocking means are constituted by at least one member adapted to clamp the free end of the strip on the work table.

A development of the invention provides, upstream of the transfer plate, a plurality of reels of strip material whose axes lie substantially in a horizontal plane positioned slightly below the surface of the transfer plate on which the multi-layer strip rests.

Said reel(s) of material is/are preferably braked.

The dimension of advance of the strip is advantageously adjustable.

In order to avoid the different layers of material adhering to one another, a steam spraying pipe is provided, adapted to humidify the different layers.

The device preferably comprises an elevator table comprising at least one horizontal plane adapted to evacuate the strip of fabric from the work station.

According to a second aspect of the invention, the device for cutting out strip flexible material comprising:

a supply device animated by a translation motion with longitudinal horizontal axis parallel to the strip, by means for displacing between a position of loading and a position of cut-out of the strip of flexible material, comprising first means for blocking said strip unwound upstream during the displacement of said supply device, and a work station comprising second means for blocking the strip and a device for cutting out said strip, is characterized in that the strip is constituted by a plurality of independent, superposed layers of material and in that the cut-out device comprises laser beam emission means and means for displacing said emission means along a longitudinal horizontal axis and a transverse horizontal axis, perpendicular to the latter, with respect to the work station.

BRIEF DESCRIPTION OF THE DRAWINGS

The invention will be readily understood in the light of the following description illustrated in non-limiting manner by the accompanying drawings, in which.

DETAILED DESCRIPTION OF THE PREFERRED EMBODIMENTS

The description of the device is based on a particular form of embodiment where the work station is a cut-out station employing laser beam, and where the strip is constituted by a material of the woven or non-woven type, foam, paper, cardboard or all materials in rolls capable of being cut out with a laser.

Figure 1:
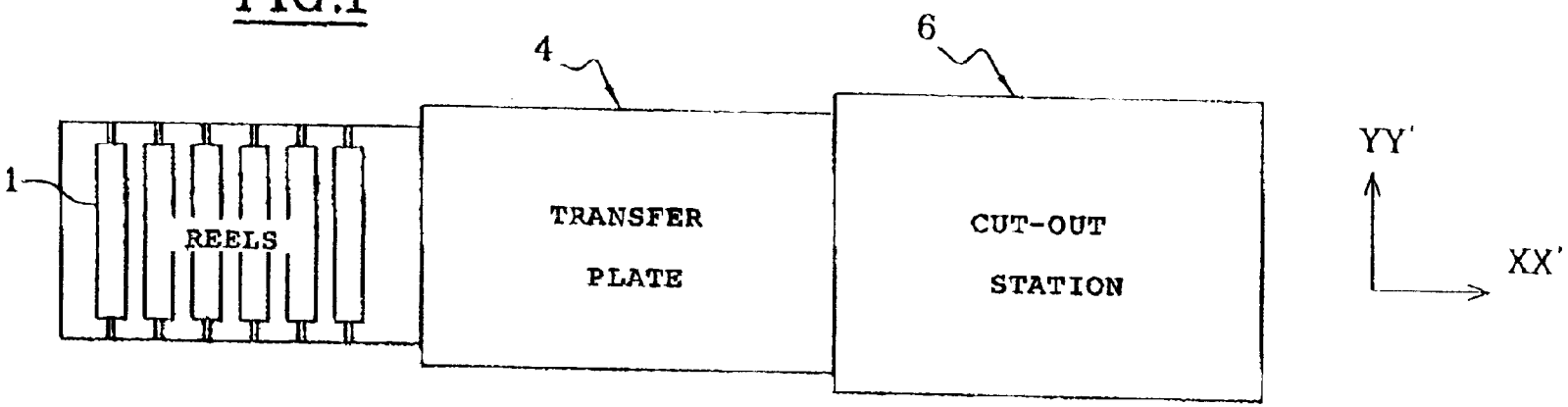
FIG. 1 shows a plan view of the device.
Figure 2:
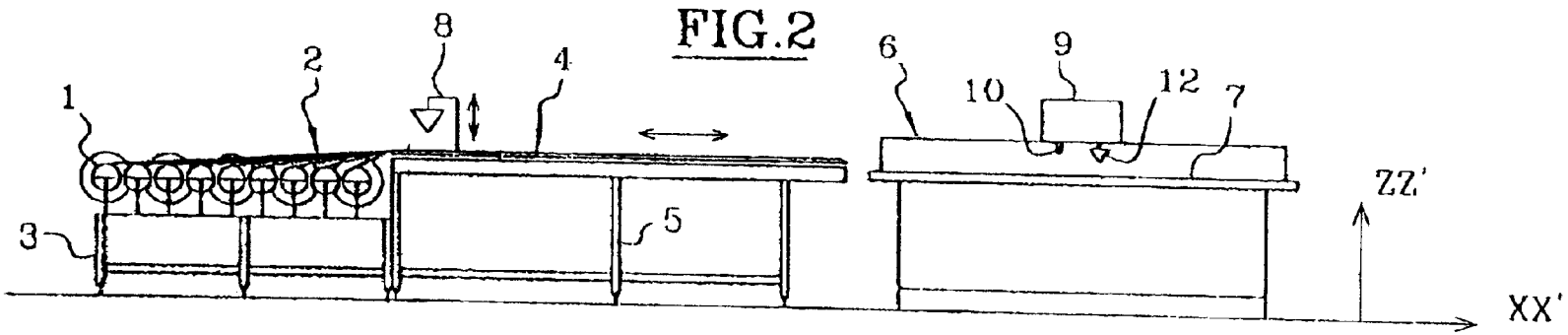
FIG. 2 is a side view of the device of FIG. 1.

The following conventions will be used all along this description:

- the direction of reading of the Figures, particularly of FIGS. 1 and 2, is from left to right along a horizontal axis X–X' in the ground plane. Thus, upstream is the part of the device most to the left, downstream lying to the right following axis X–X',
- the longitudinal direction is parallel to axis X–X', while the transverse direction represented by axis Y–Y' is perpendicular to axis X–X',
- an axis Z–Z', perpendicular to the plane defined by axes X–X' and oriented upwardly, serves as reference for measuring the height,
- the terms "width" and "length" refer respectively to the notions "longitudinal" and "transverse".

With reference to FIGS. 1 and 2, the whole of the device, except for the elevator table for evacuation, has been shown schematically in plan view and side view.

The ground is horizontal and materialized by plane X–X'Y–Y'.

A magazine of reels 1, here comprising six reels, makes it possible, downstream, to supply the device. On each reel 1 there is wound a width of a given type of fabric and the different widths 2A, 2B, 2C form independent superposed layers which constitute a strip 2. The axes of the reels 1 are horizontal and parallel to one another.

A structure 3 supports the rotation shafts of the reels 1 parallel to axis Y–Y' and disposed in the same plane parallel to the ground.

Downstream of the reels 1 is located a transfer plate 4 of rectangular shape, disposed horizontally with respect to the ground. This latter rests on a support 5 fixed with respect to the ground and presents a transverse dimension at least equal to the width of a reel 1. Said plate 4 is adapted to move in translation along axis X–X' via any known displacement means (not shown). With these latter are associated guide means (slideways, casters . . . ) and control means, all these means being known and not shown.

The plane of translation of the transfer plate 4 lies slightly above the horizontal plane defined by the axes of the reels 1.

Finally, downstream of the transfer plate 4 is arranged a work station 6 for cutting out with a laser. This station comprises a rectangular, horizontal cutout table 7 with dimensions substantially equal to those of the plate 4 and fixed with rest to the ground. Said cutout table 7 is in a plane which lies slightly below that of the transfer plate 4 in order that the latter comes into position, when it moves, above the cutout table 7.

The schematic side view of FIG. 2 shows first blocking means comprising a clamping element 8, called transfer clamp. The latter is fast with the transfer plate 4 and is produced from any known means such as for example at least two jacks disposed at the end of the transfer plate 4, towards the reels 1, aligned along an axis parallel to axis Y–Y' and spaced apart by a width slightly less than that of the reels 1.

The transfer clamp 8 is adapted to move in translation fast with the plate 4 along axis X–X' and independently of said plate 4 along axis Z–Z' in order to block the strip 2 of fabrics on said plate 4.

The cut-out station 6, besides the cut-out table 7, comprises a transverse carriage 9 mobile in longitudinal translation along axis X–X', thanks to known displacement means (not shown).

The carriage 9 comprises a means 10 (known per se) adapted to emit a laser beam 11 in order to make it possible, being piloted along axes X–X' and Y–Y', by control means not shown and known per se, to cut out the strip of fabric placed on the cut-out table 7 according to a programmed pattern.

The laser beam 11, on cutting out the strip 2, effects a micro-bum of the different layers, preventing the appearance of fibers on the edges. The garment obtained is therefore more reliable and more competitive since, in one sole operation, the invention effects at the same time the supply, cut-out and neutralization of the fibers on the edge of the superposed layers of the strip 2 of fabrics.

Moreover, on the carriage 9 there is fixed a second blocking means such as a holding clamp 12 adapted to block the strip 2 of fabrics over the whole of their width on the cutout table 7; the clamp 12 is described hereinafter.

FIGS. 3*a*, 3*b*, 3*c*, 3*d* and 3*e* schematically show in side view the respective positions of the device of the invention during an operational cycle.

The initialization (step not shown) is effected manually by the operator. This step consists in successively bringing each width of fabrics forming the strip 1 up to the end of the transfer plate 4. To that end, he draws the fabric from each reel 1, passes it beneath the transfer clamp 8 and unwinds it up to the end of the transfer plate 4, By thus superposing the different fabrics issuing from the different reels 1, a mattress is produced, placed on the plate 4.

The thicknesses, in particular those of the transfer plate 4 and the strip 2 of fabrics, have been enlarged in order to render the drawings clearer.

The transfer clamp 8 is then lowered, blocking the mattress on the transfer plate 4. The device is in the configuration shown in FIG. 3*a*.

Figure 3A:
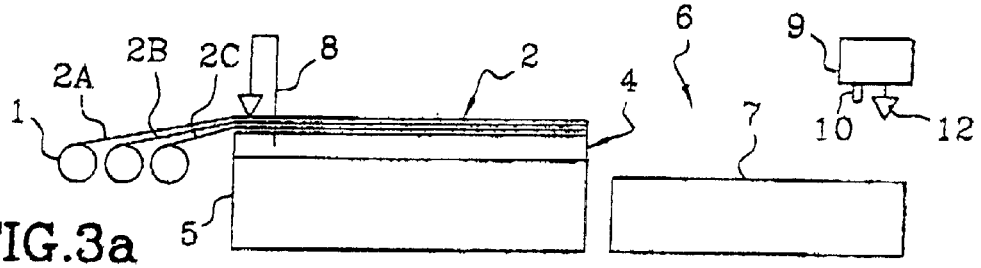
FIGS. 3*a*, 3*b*, 3*c*, 3*d* and 3*e* schematically show in side view the respective positions of the device of each step of a cycle.
Figure 3B:
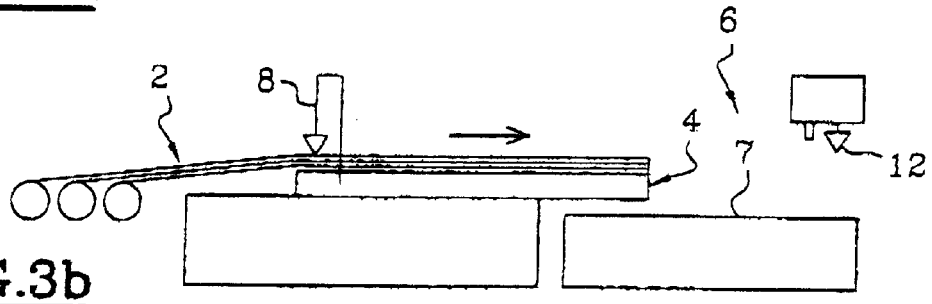

The clamp 8 is lowered when it is close to the reels 1, at the beginning of cycle, in order not to deteriorate the mattress of fabric which rests on the plate 4. As for the holding clamp 12, it is in raised position when the plate 4 begins to move in translation, as shown in FIG. 3*b*, via actuators (not shown) provided to that end.

The transfer of the plate 4 towards the cut-out station 6 effects, upstream of the plate 4, the simultaneous unwinding of the different widths of the strip 2. The dimension of advance of the transfer plate 4 may be any and therefore correspond simply to the length of fabric necessary.

Figure 3C:
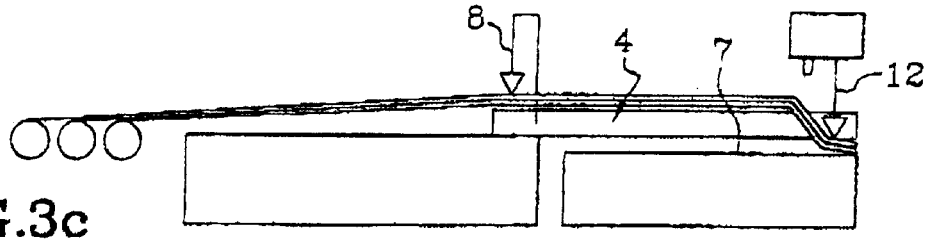

In the following step shown in FIG. 3*c*, the holding clamp 12 is brought plumb with the end of the transfer plate 4. In FIG. 3*c*, the position of the end of the plate 4 corresponds to that of the end of the cut-out table 7 since the dimension of advance represented is the maximum dimension.

Once the transfer plate 4 is in work position and immobile, the holding clamp 12 is lowered and blocks the mattress over the whole of its width on the cut-out table 7. The detail of this operation is explained hereinafter by the description of FIGS. 4*a* and 4*b*.

Figure 3D:
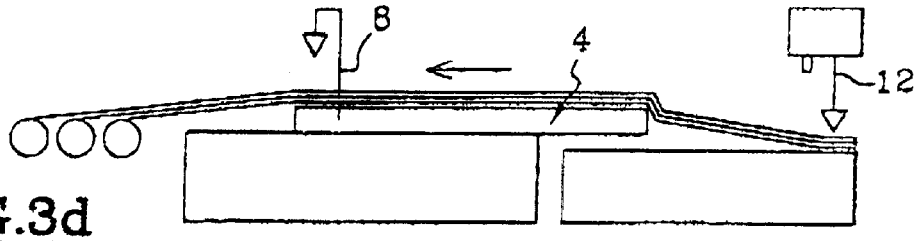
Figure 3E:
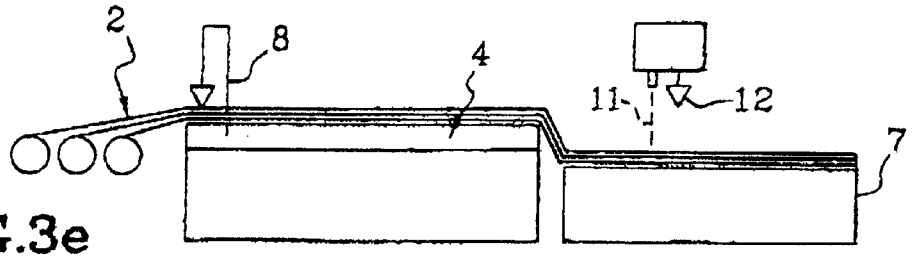

The transfer clamp 8 may then be raised and the transfer plate 4 makes the reverse path as shown in FIG. 3*d*. The mattress being blocked at its end on the cut-out table 7, the return of the plate 4 then effects, via force of friction, the smoothing of the future mattress which, during the following cycle, will be located on the transfer plate 4. When the latter is again in initial position of loading, the transfer clamp 8 is lowered then the holding clamp 12 raised, as shown in FIG. 3*e*.

That part of the mattress which then rests on the cut-out table 7 may be treated by the laser beam 11. The strip 2 is cut out according to one or more patterns before being disconnected from the following mattress by a cut-out over the whole width of the strip 2. A variant consists in firstly isolating the mattress disposed on the cut-out table 7 by cutting it over the whole of its width, the following mattress being ready for a new cycle.

Figure 4B:
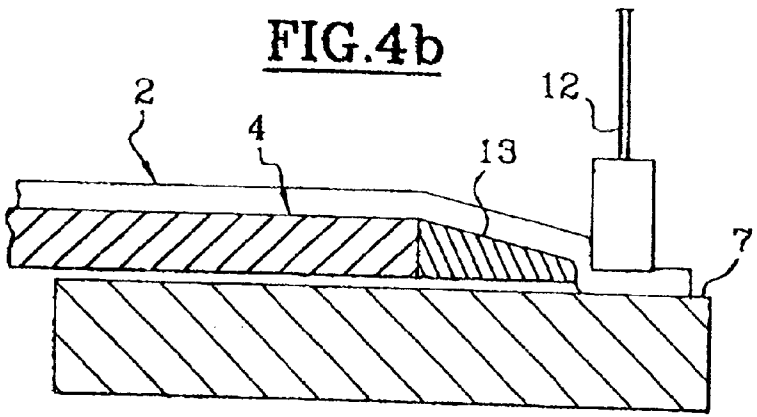
FIGS. 4*a* and 4*b* are views in section and in detail of the means for clamping the strip on the work table.
Figure 4A:
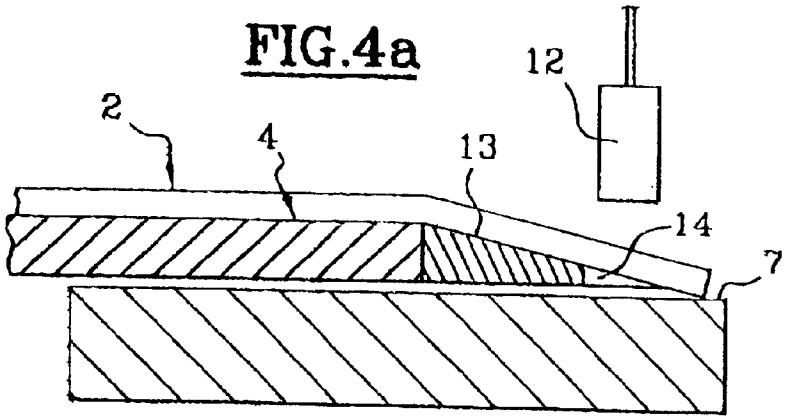

FIGS. 4*a* and 4*b* show, by views in transverse section, the details of the means for clamping the strip 2 on the cut-out table 7 by the holding clamp 12.

The mattress is held on the transfer plate 4 by the transfer damp 8 (not shown). The plate 4 is brought above the cut-out table 7 at the desired dimension of advance. In the case shown in FIGS. 4*a* and 4*b*, the dimension of advance corresponds to the maximum dimension, i.e. to the end of the out-out table 7.

At the end of stroke, the transfer plate 4 is blocked and the holding clamp 12 is lowered in order to block the mattress on the cutout table 7. A spatula 13 is connected by any known means to the end of the transfer plate 4 and at least one recess 14 is made on the edge of said spatula 13 facing downstream.

The transverse sections of FIGS. 4*a* and 4*b* pass through this recess 14.

The spatula 13 presents an inclination downstream which allows the mattress of fabric not to undergo 8 rupture of too great a tension on the downstream edge of the transfer plate 4. Thus, thanks to the spatula 13, the band 2 is brought progressively closer to the cut-out table 7 from the surface of the transfer table 4 supporting the strip.

The holding clamp 12 clamps the mattress on the cut-out table 7 passing through the recess 14 of the spatula 13. The strip 2 of fabrics is then fixed with respect to the cut-out table 7 and the transfer plate 4 may effect its return into initial position of loading.

Figure 5:
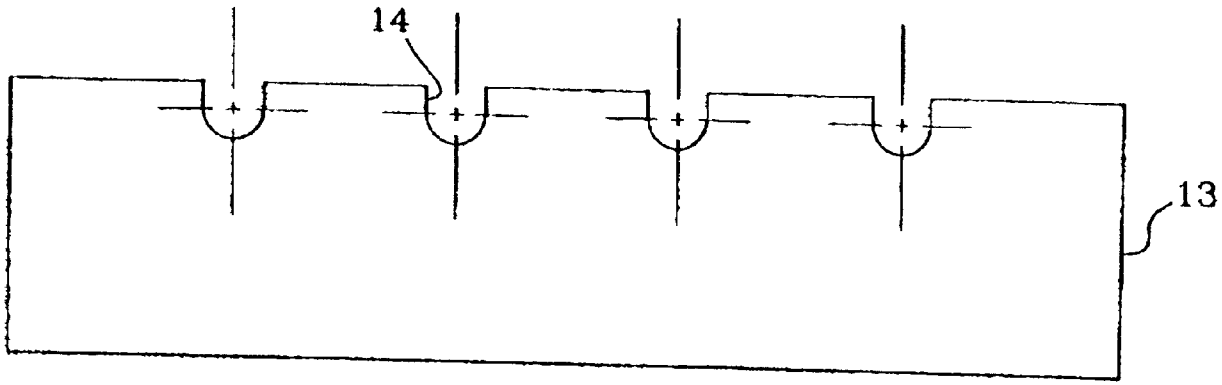
FIG. 5 is a plan view of a member associated with the blocking means fixed to the end of the transfer plate.

FIG. 5 shows, in plan view, the detail of spatula 13 according to a particular form of embodiment where the holding clamp 12 is constituted by four jacks distributed over the width of the cut-out table 7. Four recesses 14 disposed opposite these jacks are provided on the spatula 13 in order to effect a substantially uniform clamping of the strip 2 on the cut-out table 7.

The spatula 13 is generally rectangular in shape and its transverse dimension corresponds to the transverse dimension of the transfer plate 4. The spatula 13 being connected to the transfer plate 4 in its extension along axis X–X', its thickness is substantially identical to that of said transfer plate 4.

According to a variant embodiment, the second blocking means are fixed with respect to the cut-out table 7. In that case, said holding clamp 12 is independent of the transverse carriage 9 and the dimension of advance of the transfer plate 4 is no longer adjustable. In effect, for example, the holding clamp 12 may be fixed to the downstream end of the cutout table 7, the dimension of advance in that case being maximum.

What is claimed is:

1. Device for supplying a work station with a flexible material strip unwound from a reel, comprising a transfer plate, animated by a translation motion along a longitudinal horizontal axis, by displacing means, between a first position of loading the material strip and a second working position, said transfer plate including first means for blocking the material strip on said plate when the latter is moving from the loading position to the working position, the transfer plate being capable of supporting on its surface the material strip and the work station including second blocking means for retaining a free end of the material strip on said work station such that the transfer plate return travel from the working position to the loading position generates, by friction of the material strip on said plate, forces tending to smooth out a part of the material strip associated with the work station, the second blocking means being constituted by at least one means adapted to clamp the free end of the material strip in the work station.

2. Device according to claim 1, wherein a plurality of reels of material are located upstream of the transfer plate, each reel supplying a layer of the material strip, the material strip is composed of a plurality of independent, superposed layers of widths of the material.

3. Device according to claim 2, wherein the reels of material are braked.

4. Device according to claim 2, wherein axes of the plurality of reels of material lie substantially in a horizontal plane positioned below the surface of the transfer plate on which the material strip rests.

5. Device according to claim 1, wherein the means for displacing the transfer plate comprise guide means and drive means.

6. Device according to claim 1, wherein the first blocking means comprise means for clamping said strip on the plate.

7. Device according to claim 1, wherein an amount of advance of the transfer plate is adjustable.

8. Device according to claim 1, wherein the work station comprises an elevator table including at least one horizontal plane on which the material strip is adapted to rest, said elevator table being adapted to evacuate the material strip from the work station.

9. Device for cutting out flexible fabric-type material in a strip, comprising a device for supplying a work station according to claim 1, wherein the strip is constituted by a plurality of independent superposed layers of material, and further comprises a cut-out device comprising means for emitting a laser beam and means for displacing said emission means along a longitudinal horizontal axis and a transverse horizontal axis, perpendicular to the latter, with respect to the work station, so that the laser beam, on cutting out the strip, effects a micro-burn of the different layers, preventing the appearance of fibers on the edges.

10. Device for supplying a work station with a flexible material strip unwound from a reel, comprising a transfer plate, animated by a translation motion along a longitudinal horizontal axis, by displacing means, between a first position of loading the material strip and a second working position, said transfer plate including first means for blocking the strip on said plate when the latter is moving from the loading position to the working position, the transfer plate being capable of supporting on its surface the material strip and the work station including second blocking means for retaining a free end of the material strip on said work station such that the transfer plate return travel from the working position to the loading position generates, by friction of the material strip on said plate, forces tending the smooth out a part of the material strip associated with the work station, the work station including a work table on which the material strip rests during the return to the transfer plate.

11. Device according to claim 10, wherein the transfer plate, when it is in the working position, lies above and plum with the work table.

* * * * *